US006027014A

United States Patent [19]

Cochran

[11] Patent Number: 6,027,014

[45] Date of Patent: Feb. 22, 2000

[54] SINGLE SHEET MAILER WITH RETURN ENVELOPE

[76] Inventor: W. Ches Cochran, 6423 Tulip La., Dallas, Tex. 75230

[21] Appl. No.: 09/028,022

[22] Filed: Feb. 23, 1998

[51] Int. Cl.[7] ..... B65D 27/00

[52] U.S. Cl. ..... 229/70; 229/92.1; 229/301

[58] Field of Search ..... 229/92.1, 301, 229/304, 305, 92.3, 70

[56] References Cited

U.S. PATENT DOCUMENTS

| | | | |
|---|---|---|---|
| 3,243,205 | 3/1966 | Borguist . | |
| 3,419,286 | 12/1968 | Noonan et al. | 229/305 |
| 3,428,237 | 2/1969 | Dowen | 229/305 |
| 3,507,519 | 4/1970 | McNabb | 229/305 |
| 3,952,942 | 4/1976 | O'Leary et al. | 229/305 |
| 3,999,746 | 12/1976 | Gendron . | |
| 4,190,162 | 2/1980 | Buescher | 229/316 |
| 4,313,557 | 2/1982 | Foffel | 229/301 |
| 4,632,427 | 12/1986 | Angus . | |
| 4,809,905 | 3/1989 | Goodman | 229/92.1 |
| 5,104,036 | 4/1992 | Rutkowski et al. | 229/70 |
| 5,169,060 | 12/1992 | Tighe et al. . | |
| 5,285,958 | 2/1994 | Buescher et al. | 229/306 |
| 5,458,284 | 10/1995 | Haan et al. . | |
| 5,598,970 | 2/1997 | Mudry et al. . | |
| 5,642,855 | 7/1997 | Michlin | 229/306 |
| 5,664,725 | 9/1997 | Walz . | |

*Primary Examiner*—Stephen P. Garbe
*Attorney, Agent, or Firm*—R. William Graham

[57] ABSTRACT

A mailer with a return envelope includes a base substrate having a first region and a second region, a first perforated portion extending transversely across the base substrate separating the first region and the second region, an adhesive material disposed in a substantially encircling manner on an area of the first region substantially forming about an enclosed area of the first region, a printable substrate of a complimentary configuration to the base substrate and mated to the base substrate and having a first region and a second region of a complimentary configuration to the first region and the second region of the base, an adhesive material disposed between the second region of the printable substrate and the second region of the base substrate, a second perforated portion extending transversely across the printable substrate separating the first region and the second region of the printable substrate adjacent to the first perforated portion of the base substrate and a third perforated portion extending transversely across the first region of the printable substrate in generally parallel relation to the second perforated portion of the printable substrate forming a tearaway portion therebetween and a release coating disposed over a portion of the adhesive material on the first region adjacent the second perforated portion and substantially extending therealong, wherein the release coating is disposed between the tearaway portion and the adhesive on the first region of the base substrate.

6 Claims, 4 Drawing Sheets

SINGLE SHEET MAILER WITH RETURN ENVELOPE

BACKGROUND OF THE INVENTION

1. Field of the Invention

The present invention relates to a mailer with a return envelope. More particularly, the present invention relates to a mailer for use with laser or ink jet technology printers having an integrated envelope and associated printed promotional piece.

2. Related Art

There exist a number of mailers which have certain means for forming a return envelope therein. For example, U.S. Pat. No. 3,243,205 discloses a combined envelope and an attached statement wherein the statement may be folded in a manner and have a suitable adhesive applied thereto such that an envelope can be formed. U.S. Pat. Nos. 5,598,970, 5,458,284 5,169,060, 4,632,427 and 3,999,746 also show mailer with return envelopes. However, these mailers suffer in design requiring undesirable folding of mailing segments to form a reply envelope and/or fail to provide an optimal structure for suitably enabling a mailer to be made using today's printer technology, i.e., standard letter size paper as would be used in laser and ink-jet printers.

Accordingly, there remains a need to improve combination mailer envelope systems. Importantly, there is a need to optimize the mailer structure for suitably enabling a mailer to be made using today's printer technology while providing an integrated envelope.

BRIEF SUMMARY OF THE INVENTION

It is an object to meet the above needs.

It is another object to improve combination mailer envelope systems by providing a mailer with a return envelope.

It is a further object to increase the effectiveness of mailers and return response by improving the mailer and return envelope in a cost-effective manner.

Accordingly, the present invention is directed to a mailer with a return envelope. The invention includes a base substrate having a first region and a second region. A first perforated portion extends transversely across the base substrate separating the first region and the second region. An adhesive material disposed in a substantially encircling manner on an area of the first region substantially forming about an enclosed area of the first region. This enclosed area will form part of the envelope.

A printable substrate of a complimentary configuration to the base substrate is mated to the base substrate and has a first region and a second region of a complimentary configuration to the first region and the second region of the base. An adhesive material is disposed between the second region of the printable substrate and the second region of the base substrate. Likewise, a second perforated portion extends transversely across the printable substrate separating the first region and the second region of the printable substrate adjacent to the first perforated portion of the base substrate and a third perforated portion extends transversely across the first region of the printable substrate in generally parallel relation to the second perforated portion of the printable substrate forming a tearaway portion between the perforated portions. A release coating is disposed over a portion of the adhesive material on the first region adjacent the perforated portion and substantially extends along the second perforated portion. The release coating is disposed between the tearaway portion and the adhesive on the first region of the base substrate.

Additionally, the second region of the printable substrate includes a continuous line of separability surrounding and forming a separable portion. Preferably, the separable portion includes at least a portion of the adhesive coating thereon and further includes a release coating disposed between the adhesive coating and the second region of the base substrate. The separable portion may include preprinted information thereon such as a label address, for example. In this regard, there may be several separable portions.

Other objects and advantages will be readily apparent to those skilled in the art upon viewing the drawings and reading the detailed description hereafter.

DETAILED DESCRIPTION OF THE INVENTION

Figure 5:
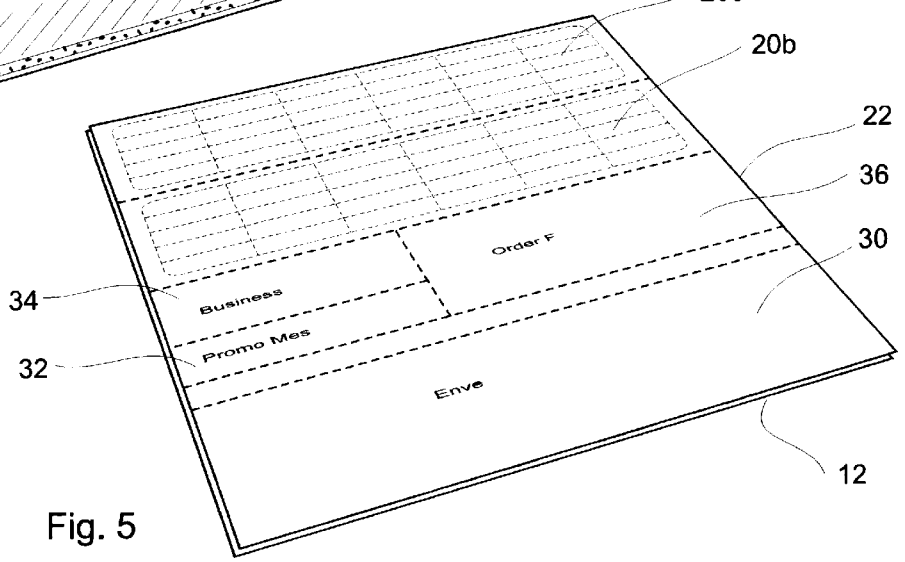
FIG. 5 is a perspective view of the embodiment depicted in FIGS. 1–5.

Referring now to the drawings, a mailer with a return envelope of the present invention is generally referred to by the numeral 10, as seen in FIG. 5. The mailer with return envelope 10 is preferably a two ply paper-based substrate which is of a length, width and construction as described herein to be single sheet fed into state of the art laser and ink jet printers. For example, the mailer with a return envelope 10 may be formed in an 8.5×11 inch sheet.

Figure 1:
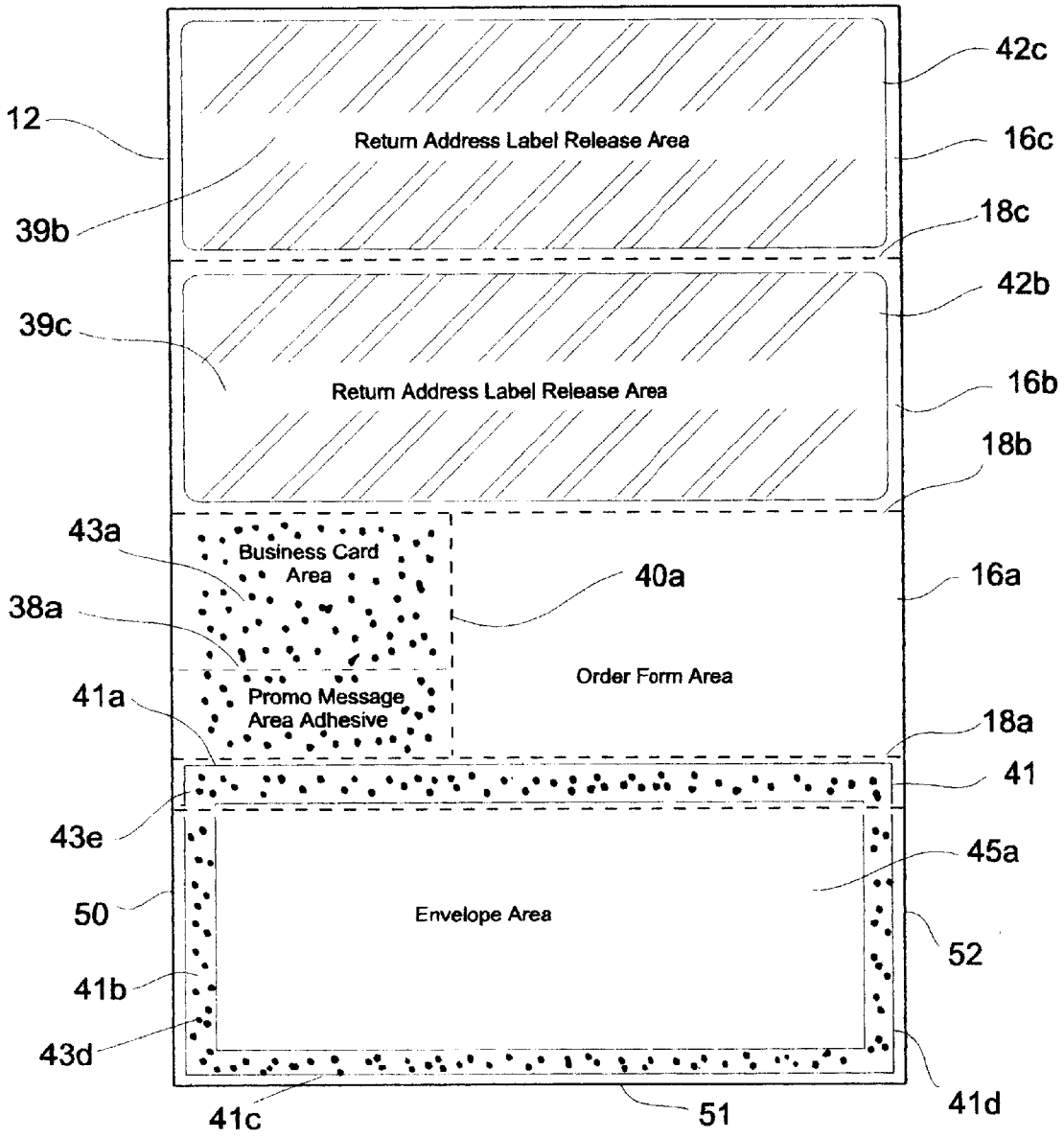
FIG. 1 is a plan view of a working side of a base substrate of an embodiment of the present invention.
Figure 2:
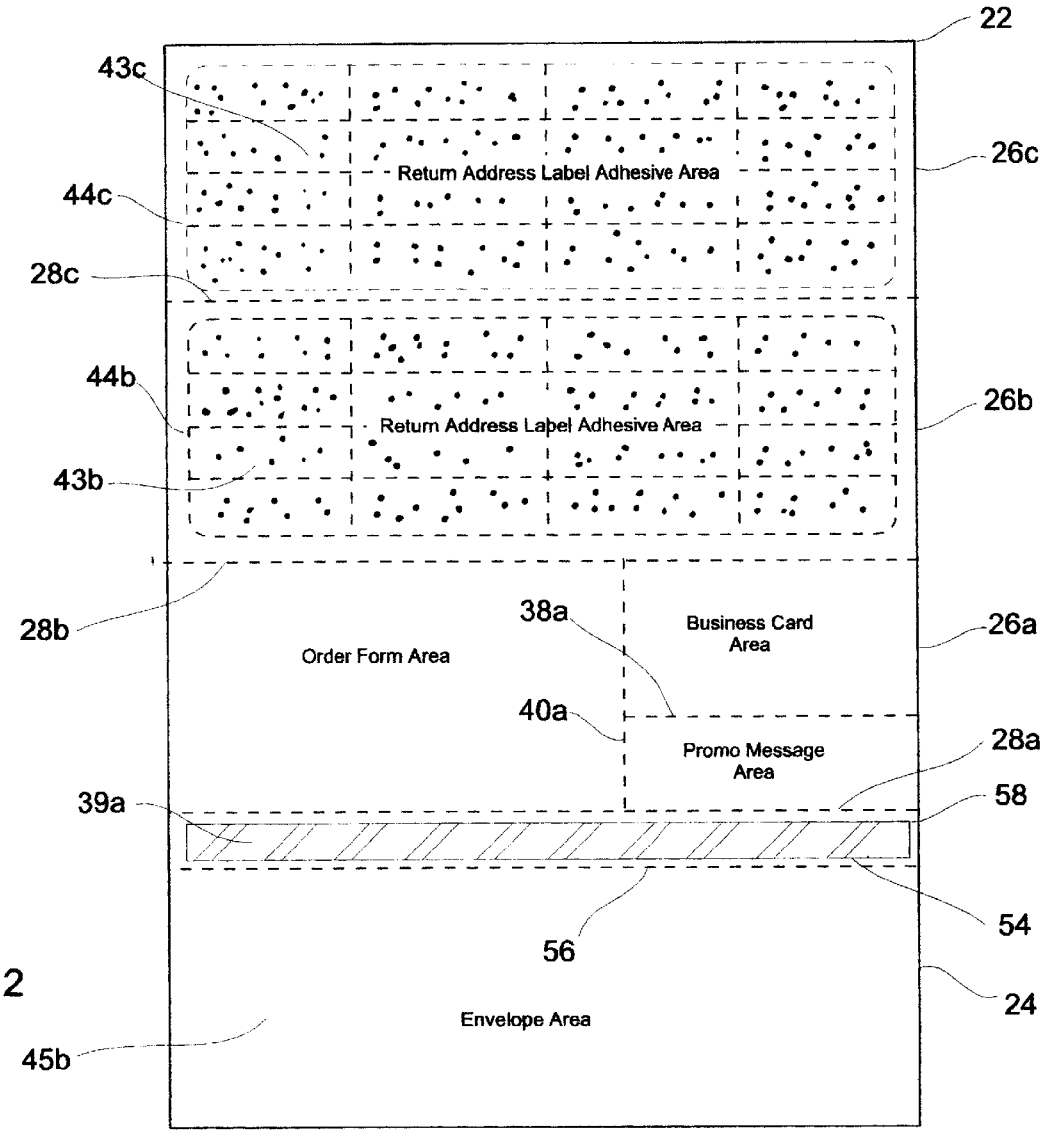
FIG. 2 is a plan view of a back working side of a printable substrate depicting adhesive coating applied to areas of the printable substrate for use as part of the embodiment with the base substrate in FIG. 1.
Figure 3:
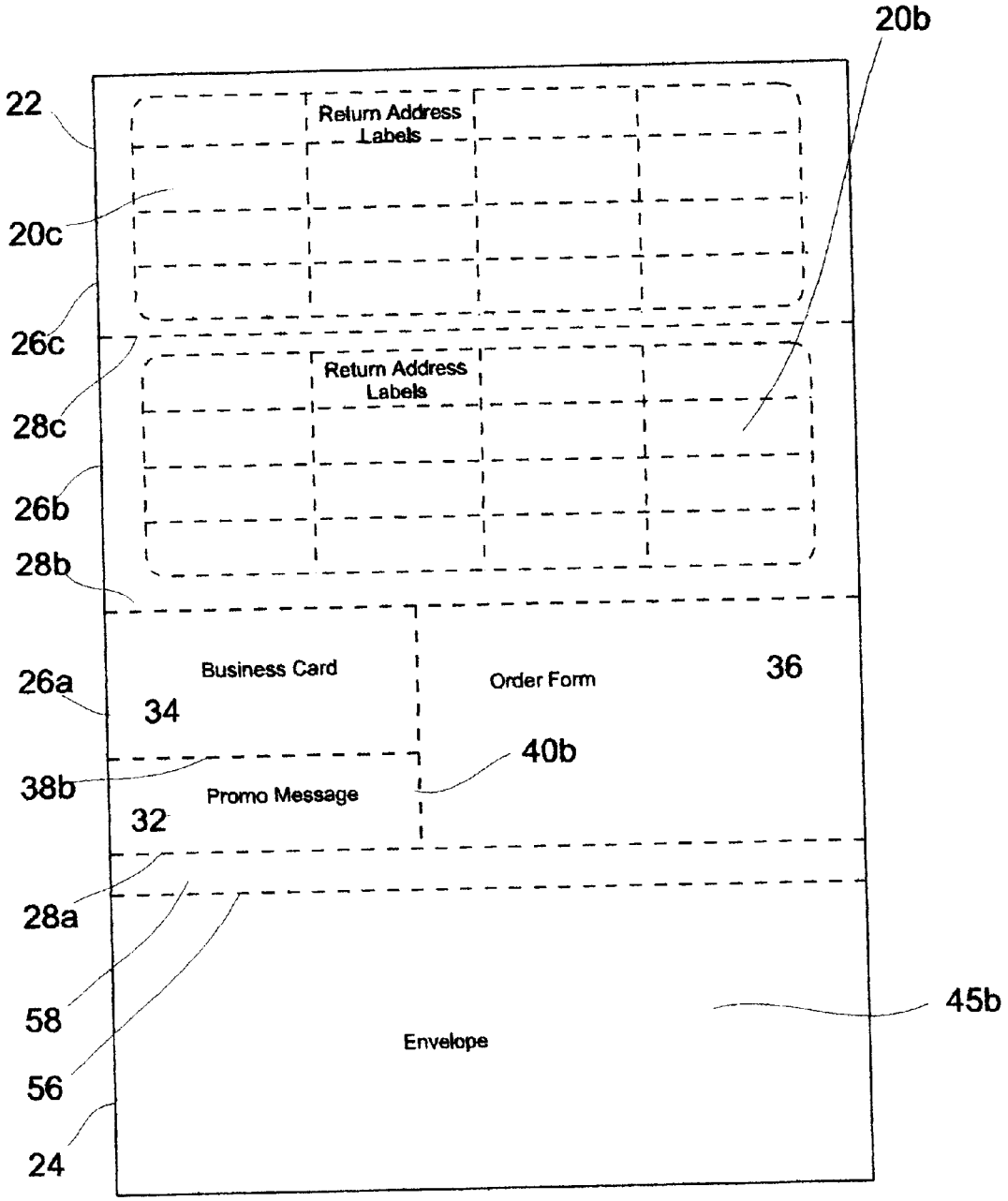
FIG. 3 is a plan view of front working side of the printable substrate depicting printed areas and cut and perforated lined areas.

The mailer with a return envelope 10 includes a base substrate 12 having a working side as depicted in FIGS. 1–3 and having a first region 14 and a second region which includes subregions 16*a*, 16*b* and 16*c*. The first region 14 preferably accounts for about one quarter of the size of the mailer with a return envelope 10. A perforated portion 18*a* extends transversely across the base substrate separating the first region 14 and subregions 16*a*, 16*b* and 16*c*.

FIG. 1 depicts subregions 16*a*, 16*b* and 16*c* separated by perforated portions 18*b* and 18*c*, respectively. In FIG. 1, subregions 16*b* and 16*c* provide areas to which precut mailing labels 20*b* and 20*c* removably attach as later herein described.

As seen in FIGS. 2 and 3, a printable substrate 22 of a complimentary configuration to the base substrate 12 is matable to the base substrate 12 as later herein described and depicted in FIGS. 10 and 11. The printable substrate 22 has a first region 24 and a second region which includes subregions 26*a*, 26*b* and 26*c*. Subregions 26*a*, 26*b* and 26*c* are separated by perforated portions 28*b* and 28*c*, respectively.

Figure 4:
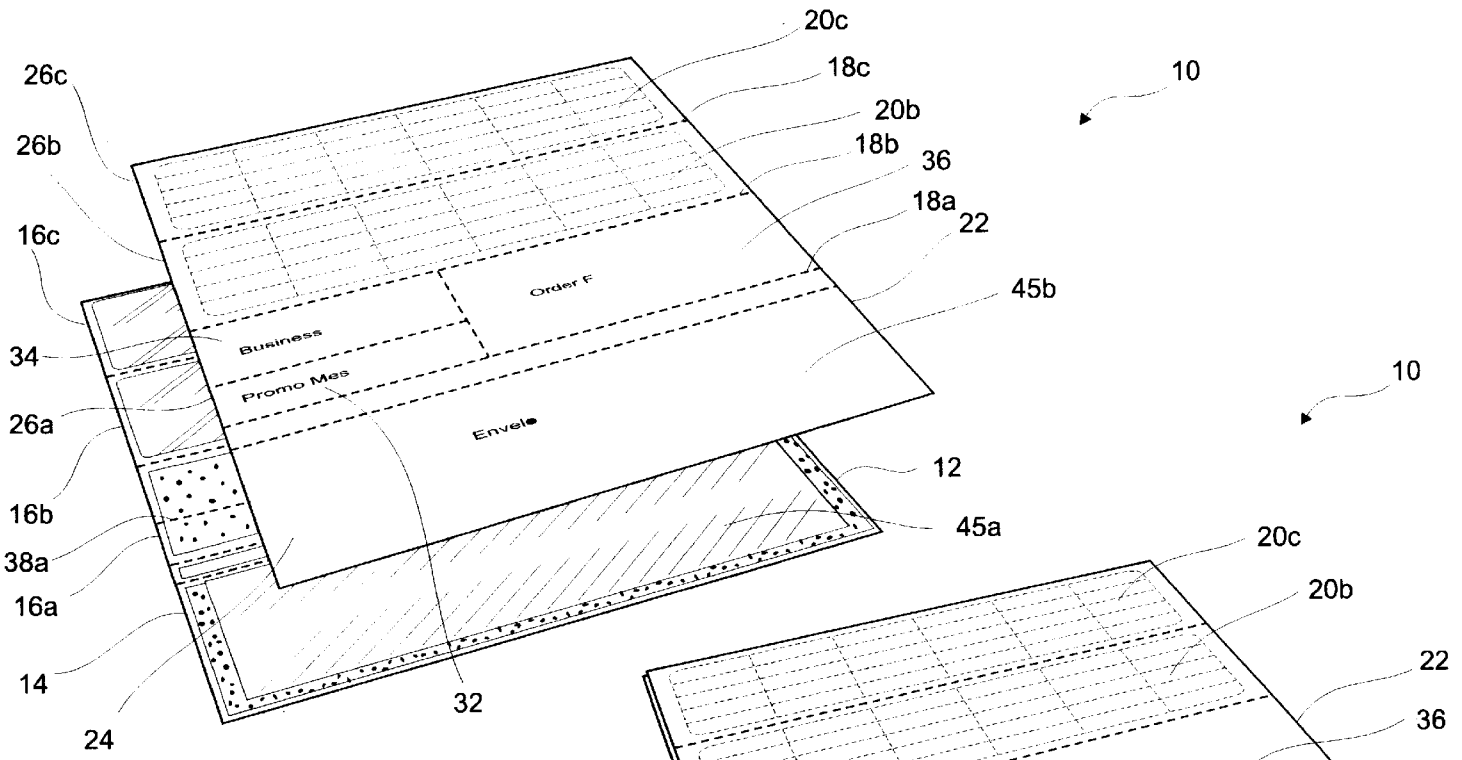
FIG. 4 is a perspective exploded view of the embodiment depicted in FIGS. 1–5.

As seen in FIG. 1, there is a predefined structure to the four regions 14, 16*a*, 16*b* and 16*c* which form part of a working surface of the base substrate 12. Region 14 will serve as a back to an envelope 30 as seen in FIGS. 4 and 5 formed by areas 45*a* and 45*b*. Region 16*a* will serve in part as a backing to a predefined advertisement portion 32 of printable substrate 22, as backing for a business card portion 34 of printable substrate 22 and to order form 36 of printable substrate 22 all of which are separable by defined lines of separation 38*a*, 38*b*, 40*a* and 40*b* imparted thereto after the substrates 12 and 22 are mated.

A release coating 39*a*, 39*b* and 39*c* such as a silicon gel, is applied to areas between the substrates 12 and 22 in order to permit separability in predetermined areas. An adhesive material 43 a–e is preferably a pressure sensitive material is utilized for connecting the base substrate 12 to printable substrate 22 in predetermined areas. The type of release coating and adhesive may vary to impart a particular desired result.

The release coating 39*b* and 39*c* is applied to areas 42*b* and 42*c* on the base substrate 12 as seen in FIG. 1 and release coating 39*a* is applied to tear away portion 58 as seen in FIG. 2. The areas 42*b* and 42*c* are on a working face side of the base substrate 12. The release coating 39*a* is also applied to an area 54 of the first region 24 adjacent the perforated portion 28*a* and substantially extends along the perforated portion 28*a*, as seen in FIG. 2.

The adhesive 43*b* and 43*c* is disposed on a back side of printable substrate 22 in regions 44*b* and 44*c* of the labels 20*b* and 20*c*, respectively, as seen in FIG. 2. In this way, when the printable substrate 22 is mated to the base substrate 12 the release coating 39*b* and 39*c* prevents the adhesive material 43*b* and 43*c* from adhering to areas 42*b* and 42*c* and in turn allows the labels 20*b* and 20*c* to be peeled away.

As seen in FIG. 1, the adhesive material 43*a*, 43*d*, and 43*e* is applied to areas 16*a*, 41*b*, and 41*a* respectively of the base substrate 12 in a substantially encircling manner on an area of the first region 14 substantially forming about an enclosed area 45*a* to which there is no adhesive material or release coating applied. The area 41*a* of the area 41 runs along the perforated portion 18*a* and the areas 41*b*, 41*c* and 41*d* of the area 41 run in an offset manner along peripheral edges 50, 51 and 52, respectively. The offset is about a sixteenth of an inch which is an amount sufficient such that when the base substrate 12 is mated to the printable substrate 22 the adhesive material 43*a*, 43*d*, 43*e* is not squeezed out beyond an edge of the mailer and return envelope 10. Also, the adhesive material 43*a*, 43*d*, 43*e* is offset from the perforated line 18*a* to enhance foldability of the mailer and return envelope 10. The release coating 39*a* applied on a portion 54 substantially extends along the perforated portion 28*a* in sufficient amount to cover the portion 41*a* when mated thereagainst.

Another perforated portion 56 extends transversely across the region 24 of the printable substrate 22 in generally parallel relation to the perforated portion 28*a* forming a tearaway portion 58. The release coating 39*a* is disposed between the perforated portions 28*a* and 56 and enable the tearaway portion 58 to be removed.

It is contemplated that in the alternative the adhesive material 43*a*, 43*d*, 43*e* could be on the back of the region 24 and the release coating 39*a* on the region 14, thus a reverse of what is shown in FIGS. 1 and 2 for the adhesive 43*a*, 43*d*, 43*e* and release coating 39*a* would exist. However, since the reader of the mailer will be viewing the printable substrate 22 from its top side as in FIG. 3, it is believed to be more convenient in this embodiment to form the tearaway portion 58 in the manner as previously described for this embodiment.

The above described embodiments are set forth by way of example and is not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A mailer having a return envelope, which comprises:

a base substrate having a first region and a second region and further having a working surface;

a first line of perforations extending transversely across said base substrate separating said first region and said second region;

a first adhesive material disposed in a substantially encircling manner on an area of said first region of said working surface such that said area forms a first side of an envelope;

a printable substrate of a complimentary configuration to said base substrate and mated to said base substrate and having a first region and a second region of a complimentary configuration and mated to said first region and said second region of said base substrate, respectively, wherein an area of said first region contacting said first adhesive material forms a second side of said envelope, said printable substrate further has a print surface and a back surface, wherein said back surface is mated to said working surface, and wherein said second region of said printable substrate includes at least one separable mailing label and a separable order form detachably defined in said region by lines of separation;

a second line of perforations extending transversely across said printable substrate separating said first region and said second region of said printable substrate and which is disposed adjacent said first line of perforations of said base substrate;

a third line of perforations extending transversely across said second side of said envelope of said first region of said printable substrate in a generally parallel relation to said second line of perforations of said printable substrate forming a tearaway portion therebetween and further characterized to have at least a portion of said first adhesive disposed between said tearaway portion and said working surface;

a second adhesive material disposed on said back surface of said printable substrate across said second region of said printable substrate in a manner to cover said separable mailing label;

a first release coating on said base substrate extending at least across said separable mailing label and between said second adhesive material and said working face; and a second release coating on said printable substrate extending across said back surface and disposed between said portion of said first adhesive material and said tearaway portion.

2. The mailer of claim 1, wherein said second region of said printable substrate includes at least one separable business card form therein which is defined by a line of separation.

3. The mailer of claim 1, wherein said second region of said printable substrate includes at least one promotional message area.

4. The mailer of claim 1, wherein said second adhesive material extends substantially across said second region of said back surface and said first adhesive extends generally along a periphery of said first region.

5. The mailer of claim 4, wherein said second region of said printable substrate includes a plurality of said separable mailing labels and said first release coating extends substantially across said second region between said labels and said second adhesive material.

6. The mailer of claim 1, which is further characterized such that said lines of separation are formed subsequent to said base substrate being mated to said printable substrate.

* * * * *